US007335832B2

(12) United States Patent
Novy

(10) Patent No.: US 7,335,832 B2
(45) Date of Patent: Feb. 26, 2008

(54) WEB CONFIGURATION IN ACOUSTIC IMPEDANCE-INDUCING DEVICE

(76) Inventor: Donald A. Novy, 1234 S. Quince Way, Denver, CO (US) 80231

( * ) Notice: Subject to any disclaimer, the term of this patent is extended or adjusted under 35 U.S.C. 154(b) by 32 days.

(21) Appl. No.: 11/308,342

(22) Filed: Mar. 17, 2006

(65) Prior Publication Data

US 2007/0214936 A1 Sep. 20, 2007

(51) Int. Cl.
*G10D 9/04* (2006.01)

(52) U.S. Cl. ..... 84/392

(58) Field of Classification Search ..... 84/392, 84/387 R, 380 R
See application file for complete search history.

(56) References Cited

U.S. PATENT DOCUMENTS 3,671,011 A * 6/1972 Oguma ..... 251/323
3,973,454 A 8/1976 Eller ..... 83/138
4,210,056 A * 7/1980 Ciccarelli ..... 84/392
4,840,250 A 6/1989 Novy ..... 181/175

* cited by examiner

*Primary Examiner*—Kimberly Lockett
(74) *Attorney, Agent, or Firm*—Kyle W. Rost

(57) ABSTRACT

A coiled blank defines two elongated parallel bands and a parallel web separating the bands. Opposite ends of the web form diagonally opposed spacer strips arranged such that, when the blank is coiled to bring the ends of the web into juxtaposition, the opposed spacer strips define between themselves an open triangle having a base lying along an edge of one of the bands. Preferably the triangle base lies along the band of greater thickness in the coiled configuration. A second embodiment provides three parallel bands and two webs. When the second blank is coiled, the second web also forms an open triangle with exposed base between opposed diagonal end spacer strips at its juxtaposed opposite ends.

4 Claims, 4 Drawing Sheets

WEB CONFIGURATION IN ACOUSTIC IMPEDANCE-INDUCING DEVICE

BACKGROUND OF THE INVENTION

1. Field of the Invention

The invention relates to acoustics and to sound-modifying devices or methods. More specifically, the invention relates to sound-modifying means with a sound path restriction. In another aspect, the invention relates to music and to accessories for musical instruments. More specifically, the invention relates to all types of wind instruments and especially to brasses and woodwinds having an air column contained therein that creates transverse sound waves when induced into longitudinal vibration.

2. Description of Related Art Including Information Disclosed Under 37 CFR 1.97 and 1.98

In a music instrument having an air column, the shape of the air column determines the resonant frequencies that will be produced by the instrument. It is known that an abrupt change in the circular cross-section of a tube introduces increased impedance and that the effect of such a discontinuity is to introduce an inductance in series with the standing waves of the air column, thereby producing a reinforced response in the instrument.

U.S. Pat. No. 3,973,464 to Donald A. Novy discloses a piston-valved brass-wind musical instrument having an exponentially offset series of reflective, elliptically constricted bore sections. The amounts of offset are based upon a percentage of the inside bore diameter taken at mid-bore length. This series of interferences, exponentially doubled at each piston's ports, creates an analogous impedance that significantly improves the response of the instrument, thereby making it easier to play and affording the player benefits of improved range, endurance, intonation and dynamic control.

U.S. Pat. No. 4,840,250 to Donald A. Novy discloses an acoustic impedance-inducing device that is axially inserted into the longitudinal air column of a wind musical instrument. This invention extended the benefits of the prior invention disclosed in the U.S. Pat. No. 3,973,464 to other types of wind instruments, including non-valved instruments.

The inserted device is structured to create a series of discontinuities in the air column. Each discontinuity is created by a ring or spiral-wound band. A series of spaced rings or bands creates two or three discontinuities. The size or radial dimension of the discontinuities should be in the ratio 1:2 or 1:2:4. Thus, if the first ring or band creates a discontinuity having an arbitrary value of one, the second discontinuity should have a radial thickness or offset of approximately twice the first; and the third discontinuity should have a thickness of four times the first. U.S. Pat. No. 4,840,250 disclosed that this structure could be achieved by a series of spiral-wound bands of appropriate lengths to form thicknesses of approximately the desired ratio when wound and inserted in the tubing or air column of a wind instrument.

Desirably, a preselected distance separates the two or more wound bands within a single inserted device. A web between each two sequential bands establishes this distance. The web is in the form of open triangles; and at each longitudinal end of the web, a normal, transverse strip connects the two bands. Further according to U.S. Pat. No. 4,840,250, each web provides a constriction between the bands, and each web blocks a portion of the neighboring bands' edges. For this reason, both the thickness of the web and the junctions with the neighboring bands have the ability to degrade the performance of the inserted coils.

It would be desirable to increase the performance of the inserted coils, or correspondingly, to reduce the degradation imposed by the web.

To achieve the foregoing and other objects and in accordance with the purpose of the present invention, as embodied and broadly described herein, the acoustic coil and method of manufacture of this invention may comprise the following.

SUMMARY OF THE INVENTION

Against the described background, it is therefore a general object of the invention to increase the performance of an inserted device similar to any of those taught in U.S. Pat. No. 4,840,250.

A related object is to increase the length of exposed edge between wound bands while maintaining an accurate position and separation between the opposite edges.

Additional objects, advantages and novel features of the invention shall be set forth in part in the description that follows, and in part will become apparent to those skilled in the art upon examination of the following or may be learned by the practice of the invention. The object and the advantages of the invention may be realized and attained by means of the instrumentalities and in combinations particularly pointed out in the appended claims.

The invention is an improved blank that is adapted to be coiled about a longitudinal axis to form an acoustical impedance-inducing device. The blank is formed of sheet material having opposite front and rear longitudinal end edges and opposite first and second side edges. The blank defines at least two elongated bands arranged in parallel, extending transversely to the longitudinal axis in a same direction from one of the side edges. The first band is of a first predetermined length between its side edges, and the second band is of approximately twice the predetermined length of the first band between its side edges. A first elongated web of approximately the same predetermined length as the first band separates the two bands and maintains the bands at a predetermined spacing along the longitudinal axis.

The web is formed of a series of spacer strips arranged in alternating diagonal positions such that a juxtaposed pair of spacer strips defines an open triangle between them, having a base edge formed by an edge of one of the bands, and the next sequential triangle in the web has a base edge defined by an edge the other of the two bands. A first diagonal end spacer strip defines the first end of the web. A second diagonal end spacer strip defines the second end of the web. The first and second end spacer strips are positioned as opposed diagonals, such that when the blank is coiled and the opposite ends of the first band are abutted, the first and last diagonal end spacer strips of the first web are brought into juxtaposition and together define a single open triangle with a base edge defined by an edge of one of the first and second bands.

When coiled to bring together the opposite side edges of the first band and to bring the second band into a spiral winding of two thicknesses, the blank forms an impedance-inducing device that can be axially inserted into the longitudinal air column of a wind musical instrument. This device includes both a first annular band of first predetermined radial thickness and a second annular band of second predetermined radial thickness, wherein the second predetermined thickness is approximately twice the first predetermined thickness. Both bands are annular with respect to a common longitudinal center axis. The first web interconnects the first and second bands. The diagonal spacer walls form an annular series of open triangles with sequential triangle bases at alternating longitudinal ends of the web.

A second embodiment of the blank provides a third band that is approximately twice the length of the second band between its side edges. A second elongated web is similar in dimension to the first elongated web and separates the second band from the third band. The blank can be coiled as previously described, now also bringing the third band into a spiral winding of four thicknesses. When the blank is coiled, the second elongated web forms an annular series of open triangles similar to the triangles formed by the first web, including an open triangle formed between first and last diagonal spacer strips of the second web.

The accompanying drawings, which are incorporated in and form a part of the specification illustrate preferred embodiments of the present invention, and together with the description, serve to explain the principles of the invention. In the drawings:

DESCRIPTION OF THE PREFERRED EMBODIMENTS

Figure 1:
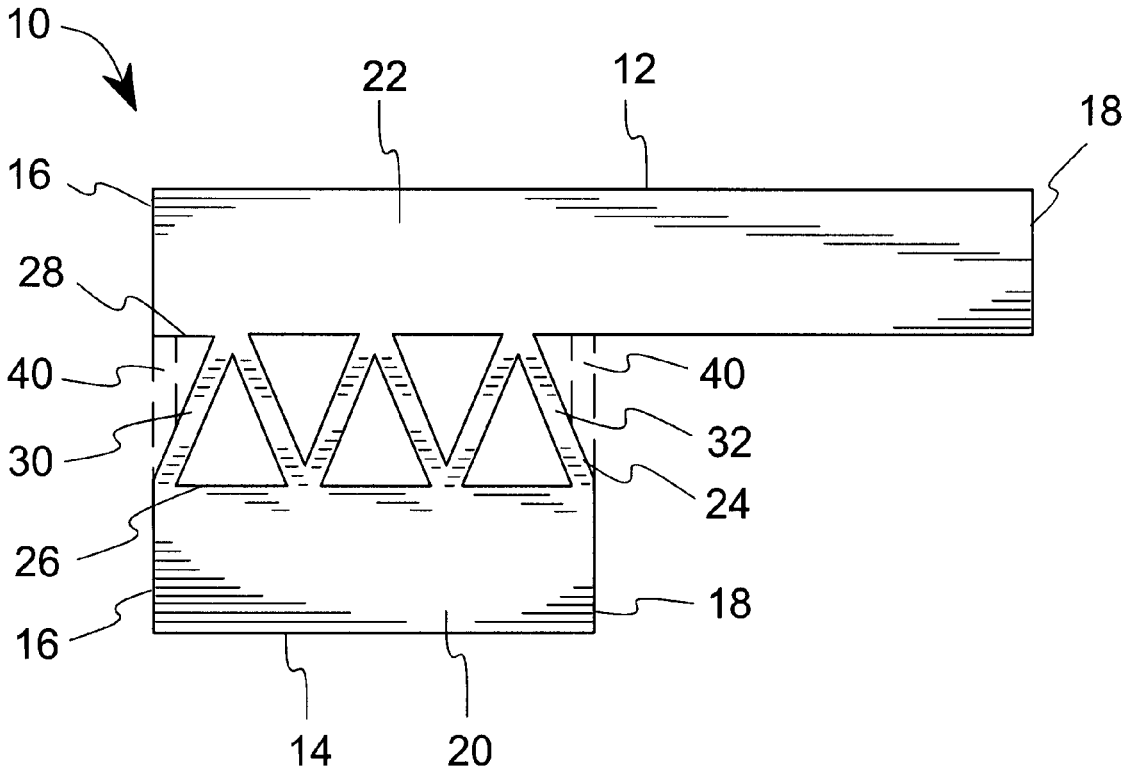
FIG. 1 is a plan view of a blank of a first embodiment for the improved impedance-inducing device the present invention, suited to form a two ring impedance-inducing device.

Incorporation by Reference: U.S. Pat. No. 4,840,250 to Donald A. Novy is hereby incorporated by reference. The incorporated patent describes an acoustic impedance-inducing device for use in the air column of a wind instrument. The device provides a series of axially spaced apart rings that can be placed in the air column of a wind musical instrument in an ordered sequence in order to create discontinuities and constrictions in the air column. In particular, the rings have a relative thickness such that each one is half the thickness of its preceding neighbor. Thus, a sequence of two such rings has a thickness ratio of 2:1 and a sequence of three such rings has a ratio of 4:2:1. The rings are spaced apart axially within the air column by a regular, predetermined spacing. A web that connects at least two of the rings achieves this spacing by holding these rings at a predetermined relative distance. A sequence of three rings is desirable. When present, the third ring also may be connected by a web to its neighbor.

The web is employed to assure that the rings maintain their spacing and position. When the rings are inserted into the air column of an instrument, the actual insertion process requires that the rings be placed within the tubing of the instrument. Some of the possible locations for insertion include a tuning slide, a tuning pipe, a lead-pipe, a tenor section, or a mouthpiece receiver. The exact preferred location depends upon the particular instrument. However, accurately placing rings in any of these locations and assuring that the rings remain in proper relative relationship would be difficult if the rings are independent of each other. Thus, the web enables the proper placement of all rings in a single insertion operation.

The design of the web is important to the proper operation of the impedance-inducing device. The radial thickness of the ring is a direct factor in producing a constriction in the air column and in creating the desired impedance. However, the transverse or longitudinally facing edges of the rings also function to propagate reinforcing sound waves. The web covers a portion of these transverse edges and, thus, eliminates such a portion of the edges from active participation in the process of improving the response of the instrument. The preferred web design minimizes the covered portion of the transverse ring edges.

Since instrument bores may differ in diameter both between manufacturers and models, an insertable and removable ring requires some means of being adapted to small variations in bore size. Thus, the rings are formed in wound coils and are produced from a material having resilience in the coil structure. The preferred material is industrial polyester, which can be obtained in sheets of uniform, predetermined thickness. The impedance-inducing device can be cut as blanks from such sheets and then wound into the desired coil shape. The coiled blanks can be placed in a cylindrical container, heat treated, and then cooled to cause the new shape to become permanent, although the sheet maintains resilience within the coil shape. Thus, the coil can be compressed for purposes of insertion into an instrument, and the natural resilience will cause the coil to spring outwardly for purposes of position retention within the instrument's tubing.

The present invention is an improvement in the configuration of the blank. More specifically, the invention modifies the web structure to increase the available length of edges extending transversely to the air column. The improvement can be measured quantitatively as at least a sixteen percent improvement.

A first embodiment of the invention is a blank 10 shown in FIG. 1. For convenience of description, a longitudinal dimension of the blank or a longitudinal axis is deemed to extend between the front and rear edges, which are the top and bottom edges of the blank according to the view of FIG. 1. A lateral dimension is deemed to extend between the right and left sides of the blank in the view of FIG. 1. Thus, the front edge of the blank 10 in FIG. 1 corresponds to a front or forward edge 12, and a rear edge of the blank corresponds to rear edge 14. A first side edge corresponds to edge 16 at the left side in the view of FIG. 1. The second, opposite side edge of the blank lies to the right in the view of FIG. 1 and is identified as number 18. The blank includes a first band 20 and a second band 22. The two bands are parallel and the second band is approximately twice the length of the first. Both bands originate at the first side edge 16 and extend in a common transverse direction toward a second side edge 18. Although the first band 20 is shorter than the second, the second side edge of the first band will be identified by the numeral 18.

Figure 2:
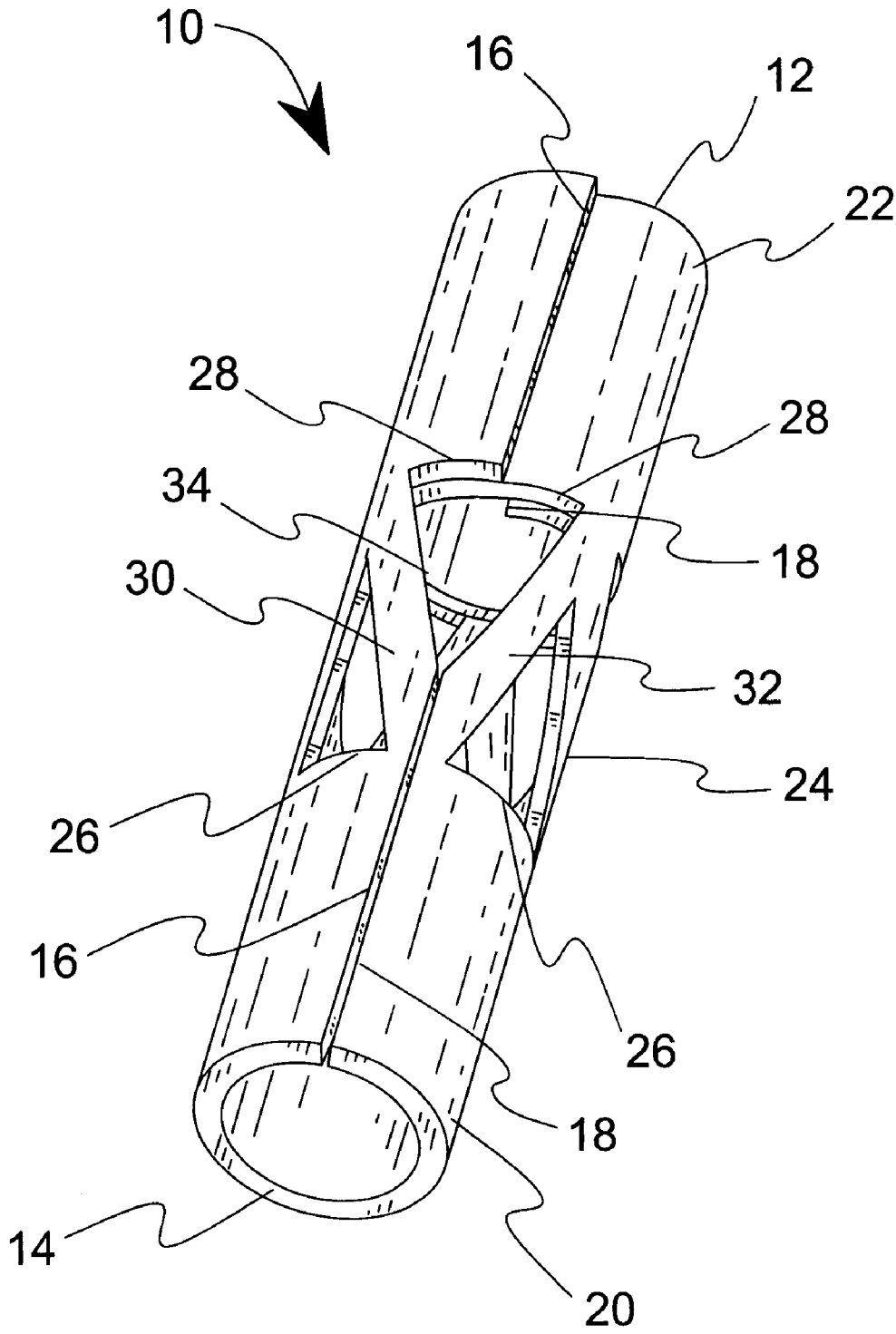
FIG. 2 is an isometric view of the blank of FIG. 1 configured for operation in the air column of a wind musical instrument.

The bands can be wound about a longitudinal axis into an approximately cylindrical or coiled shape best illustrated in FIG. 2. Preferably, the first band 20 forms a single layer, such that side edges 16 and 18 abut. The second band 22 forms a double layer spiral, with the second side edge 18 wound inside the coil from the first side edge 16. The resulting second annular band 22 will have twice the wall thickness as the first band 20.

A first web 24 interconnects bands 20 and 22. Edge 26 of band 20 forms a rear edge to the first web. Edge 28 of band 22 forms the front edge of the first web. The length of the first web 24 is similar to the length of the first band 20, sufficient to form approximately a single revolution when the blank is coiled. The first web is formed of diagonally extending spacer strips in a zigzag, alternating, or opposed diagonal pattern. For convenience of reference, the strips can be identified as forward diagonal strips 30 and backward diagonal strips 32, which are defined as being opposed diagonals that meet at an acute angle. Together with the two bands 20 and 22, each pair of juxtaposed diagonal strips 30, 32 in the central portion of the first web defines an open triangle in which the base of each open triangle is a transversely extending edge of one of the band edges 26, 28. The open triangles are in nested or alternating inverted configuration, such that one open triangle in the center portion of first web 24 has a base edge 26 of band 20, while the next sequential open triangle in the center portion of the first web 24 has a base edge 28 defined by band 22.

The first web includes both a first spacer and a last spacer strip, located respectively at the opposite sides 16, 18 of the first web. The opposite end spacer strips are diagonally opposed. For example, the first spacer strip is a forward diagonal strip 30 and the last spacer strip is a backward diagonal strip 32. When the blank is coiled and the opposite ends of the first band 20 are abutted, the opposed first and last diagonal spacer strips of the first web 24 are brought into juxtaposed position, defining between them an open first triangle 34, FIG. 2. Separated portions of one of the first and second bands define the first base edge of the first triangle 34. As shown in FIG. 2, according to the preferred arrangement, the first triangle base is formed of portions of edge 28 of the longer band 22. This edge of the longer band is thicker than edge 26 of the shorter band and, therefore, provides relatively greater reflection of sound waves. The first triangle 34 provides a marked improvement over the prior practice of employing axial end strips 40, shown in phantom in FIGS. 1 and 3, at the opposite ends of the first web.

Figure 3:
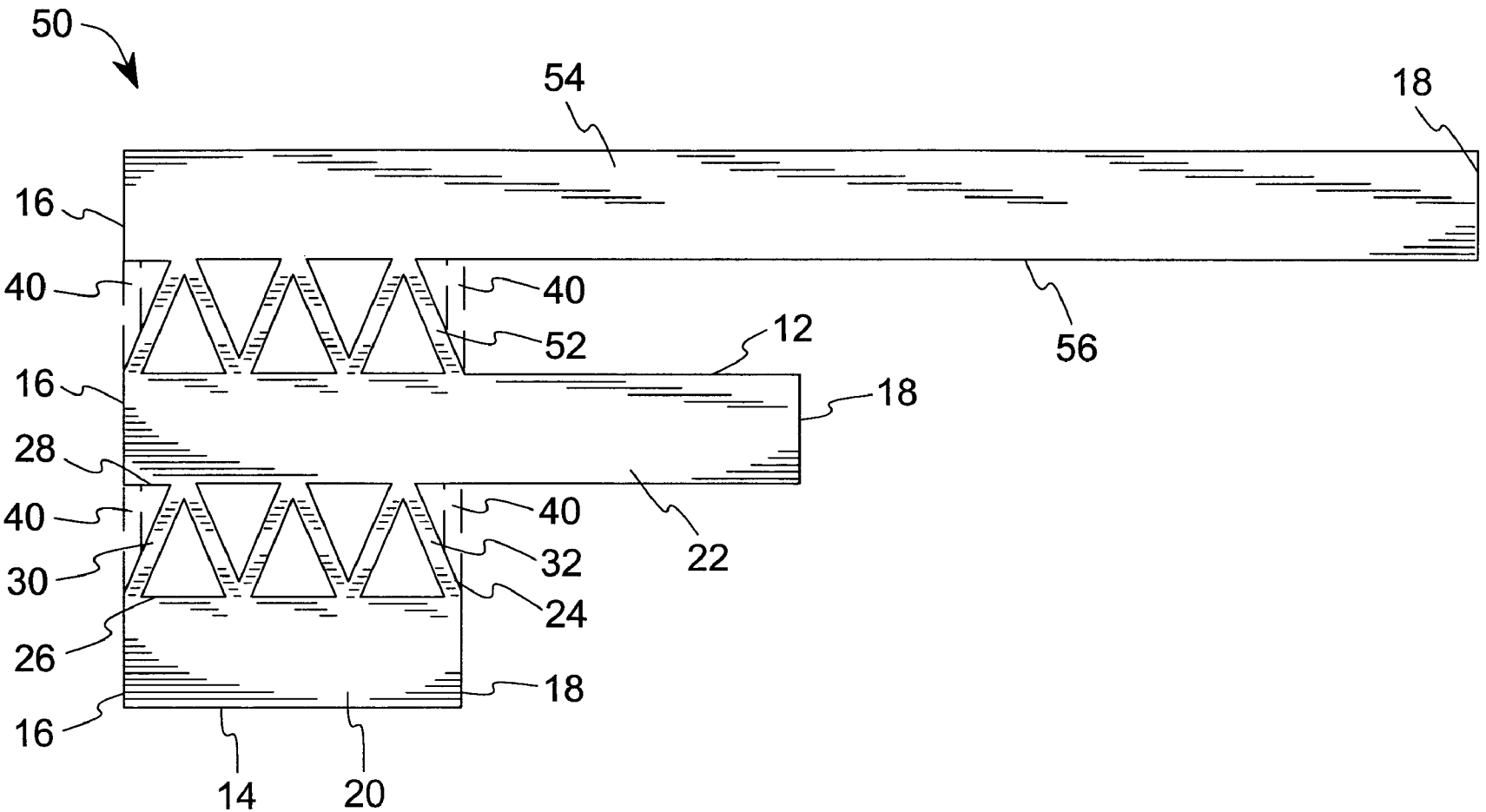
FIG. 3 is a plan view of a blank of a second embodiment of the impedance-inducing device, suited to form a three ring impedance-inducing device.
Figure 4:
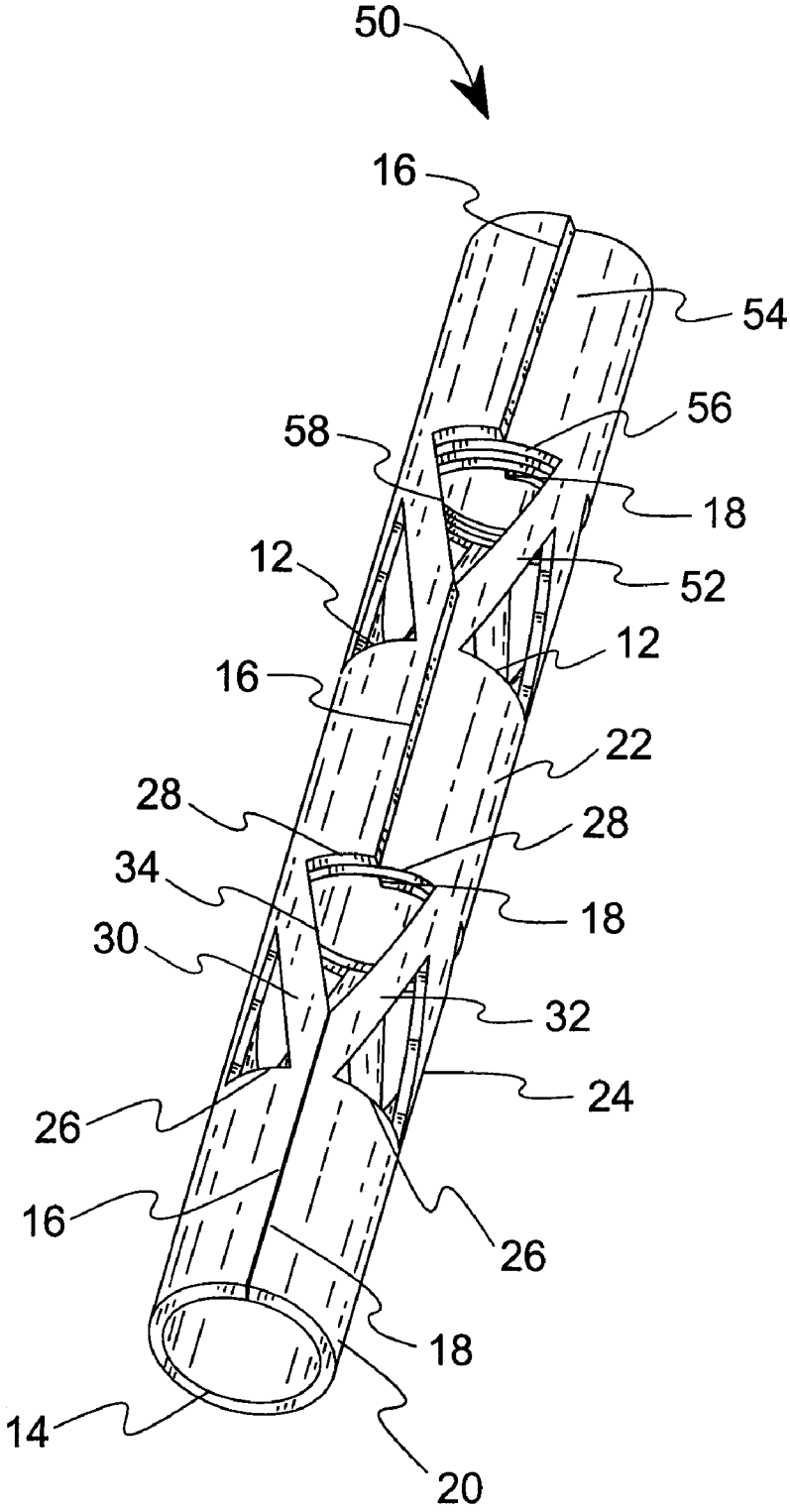
FIG. 4 is an isometric view of the blank of FIG. 3 configured for operation in the air column of a wind musical instrument.

A second embodiment of a blank 50, best shown in FIG. 3, employs three elongated, parallel bands. Portions of the second embodiment were described, above. The identification numbers previously assigned are applied to similar structures in FIGS. 3 and 4. A first web 24 is needed in order to separate the first band 20 from the second band 22. A second web 52 is needed in order to separate the second band 22 from the third band 54. The second web 52 can be of the same length and width as first web 24. The third band 54 is approximately twice the length of second band 22. When coiled as shown in FIG. 4, band 54 forms a ring of twice the thickness of coiled band 22.

The second web 52 is substantially identical to first web 24 and defines similar nested open triangles at the center of the second web, with the base edges of the triangles aligned with the elongated edges of the bands. Specifically, the front edge 12 of second band 22 borders the rear edge of second web 52, and a rear edge 56 of the third band 54 borders the front edge of second web 52. The second web is formed of opposed, forward and backward diagonal strips similar to those previously described. When the blank 50 is coiled as shown in FIG. 4, and the opposite ends 16, 18 of the first band 20 are abutted, the diagonal strips at the opposite ends of second web 52 are brought into juxtaposed position. The end diagonal strips of the second web define an open second triangle 58, similar to open first triangle 34. The base of the second triangle 58 lies along portions of third band edge 56. This base exposes a four-layer edge 56 for reflection of sound waves, thereby improving the performance of the acoustic impedance-inducing device 50 over the use of axial end strips 40 as practiced in the prior art.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be regarded as falling within the scope of the invention as defined by the claims that follow.

What is claimed is:

1. In a blank adapted to be coiled about a longitudinal axis to form an acoustic impedance-inducing device for placement in the air column of a wind instrument, said blank including at least first and second parallel bands separated by a first web, each extending transversely to the longitudinal axis, said first band being of a first predetermined length, said second band being of approximately twice said predetermined length, and said first web being of approximately the predetermined length and formed of a series of diagonal spacer strips in alternating opposed diagonal arrangement, the improvement comprising:

a first side edge of the first web is defined by a first diagonal end spacer strip;

a second side edge of the first web is defined by a second diagonal end spacer strip; and said first and second diagonal end spacer strips are oriented with respect to each other as opposed diagonals such that when the blank is coiled, bringing the first and second side edges of the first web into juxtaposition, the first and second end spacer strips of the first web define an open first triangle between the first and second end spacer strips and expose a first triangle base lying along an edge of one of said first and second bands.

2. The blank of claim 1, wherein:

said exposed first triangle base is an edge of said second band.

3. The blank of claim 1, further including a third band arranged in parallel to said first and second bands and separated from the second band by a second web, the third band being of approximately four times said predetermined length, said second web being of approximately the length of said first web and formed of a series of diagonal spacer strips in alternating opposed diagonal arrangement, further comprising:

a first side edge of the second web is defined by a first diagonal end spacer strip;

a second side edge of the second web is defined by a second diagonal end spacer strip;

said first and second diagonal end spacer strips of the second web are oriented with respect to each other as opposed diagonals such that when the blank is coiled, bringing the first and second side edges of the second web into juxtaposition, the first and second end spacer strips of the second web define an open second triangle between the first and second end spacer strips of the second web and expose a second triangle base lying along an edge of one of said second and third bands.

4. The blank of claim 3, wherein:

said exposed second triangle base is an edge of said third band.

* * * * *